United States Patent [19]

Garcia

[11] 3,954,078

[45] May 4, 1976

[54] METHOD OF CONNECTING ADJACENT UNITS OF A BARGE TOW

[76] Inventor: Emilio C. Garcia, 441 Gravier St., New Orleans, La. 70130

[22] Filed: Feb. 21, 1974

[21] Appl. No.: 444,586

[52] U.S. Cl. ..... 114/235 R; 114/77 R

[51] Int. Cl.[2] ..... B63B 21/00

[58] Field of Search ..... 114/235 R, 235 A, 77 R; 293/69 R; 213/223; 254/93 HP

[56] References Cited

UNITED STATES PATENTS

| | | | |
|---|---|---|---|
| 2,609,177 | 9/1952 | Hughes | 254/93 HP |
| 3,362,372 | 1/1968 | Peterson | 114/235 R |
| 3,492,964 | 2/1970 | Garcia | 114/235 R |
| 3,613,628 | 10/1971 | Garcia | 114/235 R |
| 3,820,258 | 6/1974 | Fahrner | 114/235 R |

*Primary Examiner*—Trygve M. Blix
*Assistant Examiner*—Charles E. Frankfort
*Attorney, Agent, or Firm*—James B. Lake, Jr.

[57] ABSTRACT

Connecting adjacent units of a tow with rigid loosely interlocking connections and preloading the connections beyond the limit of expected tow loads for any inland waterway conditions to be encountered. Preloading is accomplished by inflating hollow cushions inserted uninflated between loosely interlocked parts.

4 Claims, 2 Drawing Figures

METHOD OF CONNECTING ADJACENT UNITS OF A BARGE TOW

The invention relates generally to marine tows and more particularly to a method of unbreakably connecting adjacent units of a tow for inland waterways.

Heretofore barges of a marine tow have been interconnected with flexible cables or hawsers having tensile strengths dependent on the respective diameters and materials. Larger cables are too unwieldy for barge use, and increasing the number of cables is time and labor consuming and not amenable to meet abruptly arising emergencies which arise too infrequently to provide for economically all of the time. Thus on occassions barges break away from tows to cause great damage to other shipping, docks and themselves and the risk heretofore has been more acceptable than available alternatives for the reasons given above.

It is an object of the invention to provide rigid loosely interlocking connecting means having ten to twenty times the tensile strength of wire cable presently used and to preload each said connecting means an amount exceeding operating loads by any desired factor of safety within said maximum tensile strength of the connecting means.

Another object of the invention is to provide means for varying preloading easily and quickly to meet any emergency.

Figure 1:
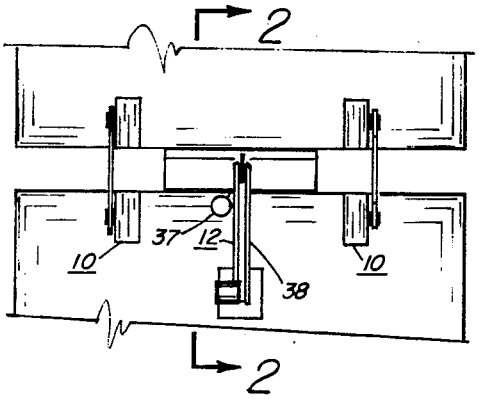
Figure 2:
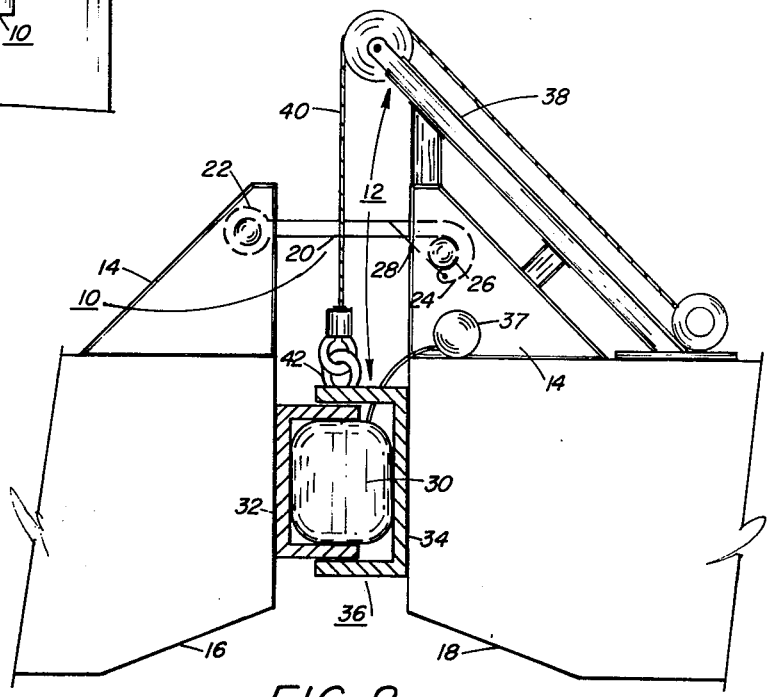

Other objects and a fuller understanding of the invention may be had by referring to the following description, claims and drawings in which:

FIG. 1 is a plan view of a preferred specie of the invention mounted on adjacent ends of barges, partially shown, FIG. 2 is a cross-section taken along section lines 2—2 of FIG. 1, and Referring to FIG. 1, the invention comprises a rigid interconnecting means 10 and preloading means 12 respectively mounted on deck structures 14 (see FIG. 2 also) and suspended between adjacent ends 16 and 18 of a pair of in-line partially shown barges. A preferred specie comprising a rigid hook-shaped connecting bar 20, having oppositely disposed ends 22 and 24, is pivoted by end 22 to one of deck structures 14, and the other hooked free end 24 engages a catch 26 mounted on the other deck structure 14. A closure 28 is adapted to close free hooked-end 24 after engagement with catch 26. The preferred preloading means 12 comprises an inflatable plastic cushion 30 mounted between slidably engaging enclosures 32 and 34 that in combination form an expandable bumper 36 which is suspended in an unexpanded condition between said barge ends 16 and 18 by a crane 38 and a supporting line 40 secured to an eye 42 on enclosure 34. The length of connecting bar 20 in engagement with catch 26 is limited to provide easy entrance of said unexpanded bumper 36 between adjacent barge ends 16 and 18 and preloaded engagement therebetween when said bumper 36 is expanded by inflating the plastic cushion 30 with any convenient pump means 37. By controlling pumping means 37, preloading may be rapidly varied to meet any operating contingencies encountered during the operation of the tow.

The inflation of said cushion may be by air or by liquid.

What is claimed is:

1. Method of connecting spaced-apart adjacent ends of units of a marine tow comprising the steps of:

a. engaging spaced-apart adjacent ends of units with loosely-engaging rigid connecting means;

b. inserting deflated cushions between said unit ends; and c. inflating said deflated cushions to expand and preload said rigid connecting means beyond anticipated tow loads plus an additional factor of safety load for precluding all relative movement between said connecting means and said units and the separation thereof until preloading is released by deflation.

2. Method of connecting spaced-apart adjacent ends of units as described in claim 1 wherein said deflated cushions are enclosed in expandable enclosures for preventing frictional engagement between cushions and adjacent ends of units.

3. Method of connecting spaced-apart adjacent ends of units as described in claim 1 wherein said deflated cushions are inflatable pneumatically.

4. Method of connecting spaced-apart adjacent ends of units as described in claim 1 wherein said deflated cushions are inflatable hydraulically.

* * * * *